US005095685A

United States Patent [19]

Latham

[11] Patent Number: 5,095,685

[45] Date of Patent: Mar. 17, 1992

[54] PIVOTABLE SANDWICH BAG ASSISTANCE DEVICE

[75] Inventor: Peter A. Latham, Boston, Mass.

[73] Assignee: HCL Limited, Conn.

[21] Appl. No.: 532,454

[22] Filed: Jun. 4, 1990

[51] Int. Cl.[5] ..... B65B 39/00

[52] U.S. Cl. ..... 53/473; 53/255; 53/384.1; 53/390

[58] Field of Search ..... 53/390, 255, 260, 384, 53/473, 468, 384.1

[56] References Cited

U.S. PATENT DOCUMENTS

| | | | |
|---|---|---|---|
| 945,572 | 1/1910 | Murray | 53/255 |
| 1,188,192 | 6/1916 | Miller | 53/255 |
| 2,528,463 | 10/1950 | Whetzell | 53/255 |
| 2,554,624 | 5/1951 | Lorentzen | 53/255 |
| 2,555,585 | 6/1951 | Fairbank | 53/255 |
| 2,656,082 | 10/1953 | Brown | 53/255 |
| 2,780,901 | 2/1957 | Youngblood | 53/384 |
| 3,152,430 | 10/1964 | Killeen | 53/255 |
| 4,890,652 | 1/1990 | Hoerner | 53/390 X |

FOREIGN PATENT DOCUMENTS 410133 2/1925 Fed. Rep. of Germany ..... 53/255

*Primary Examiner*—James F. Coan

*Attorney, Agent, or Firm*—Davis, Bujold & Streck

[57] ABSTRACT

A method and device for assisting a user with transferring an object supported by the device into a flexible storage container, the device comprising a substantially flat base member having a pair of opposed side edges and a pair of opposed end edges, a side wall extending substantially perpendicular from one surface of the base member along each of the two opposed side edges, and a protrusion member projecting substantially normal from the opposite surface of the base member, for providing a pivot about which the device can pivot, the protrusion member being positioned substantially along a traversed axis of the device and being spaced from each of the opposed end edges so that when the device is placed upon a flat support surface and the protrusion member engages that support surface, the device is pivotable about the protrusion member whereby only one end edge of the base member is able to contact that support surface at any given time thereby facilitating engagement with a storage container and transfer of an object.

17 Claims, 3 Drawing Sheets

FIG. 2
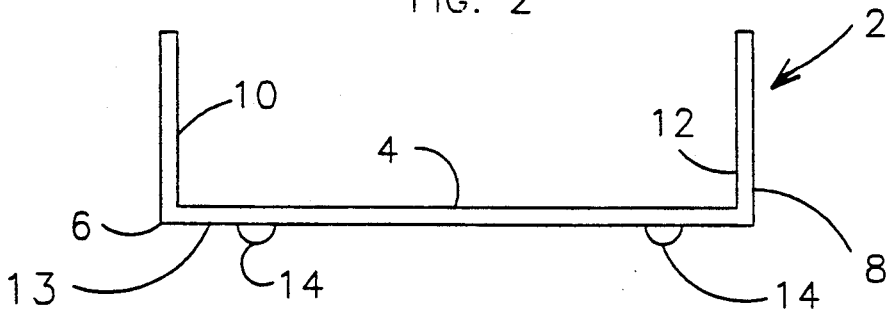
FIG. 1
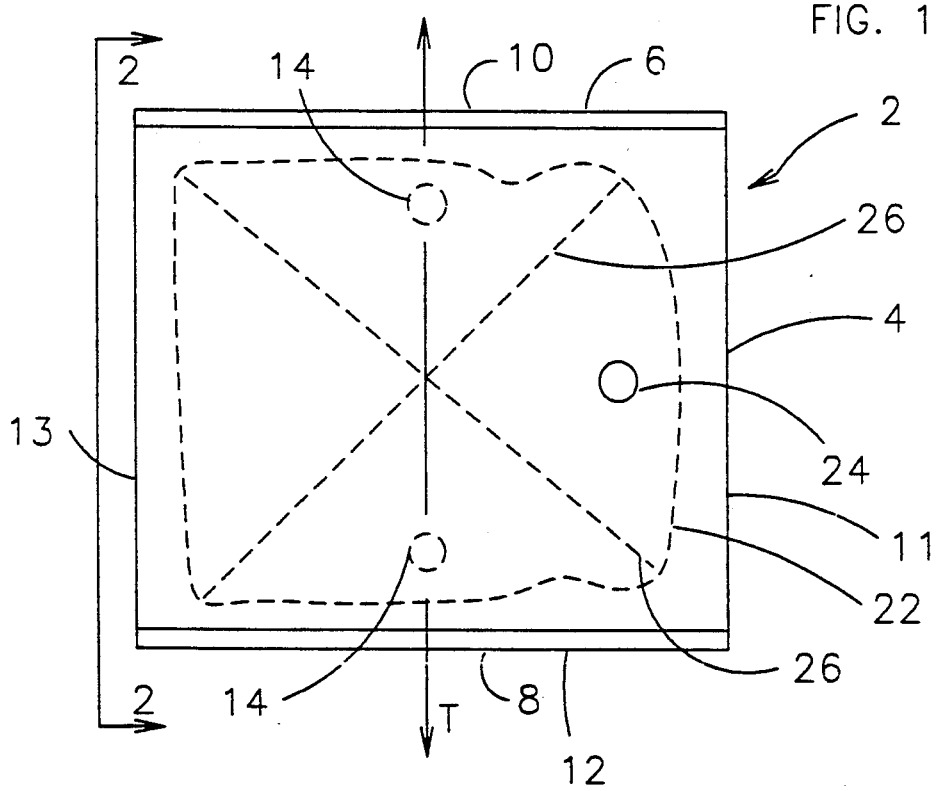
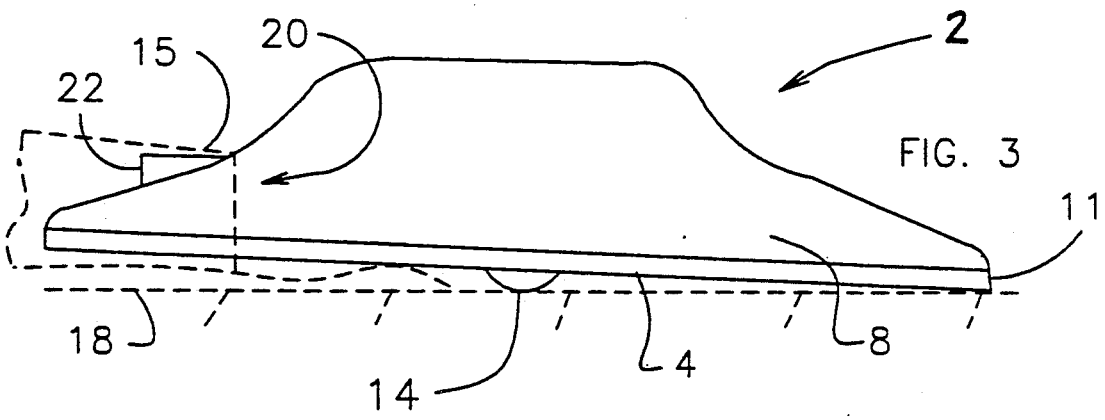
FIG. 3

PIVOTABLE SANDWICH BAG ASSISTANCE DEVICE

The present invention relates to a device for supporting a sandwich or other object and allowing easy and convenient transfer of the object from the device into a sandwich bag or some other flexible storage container.

BACKGROUND OF THE INVENTION

There are a variety of known prior art devices which assists with dispensing a product into a container, see for instance U.S. Pat. Nos. 1,188,192, 2,528,463, 2,554,624, 2,555,585, 2,656,082, 2,780,901, 3,152,430 and 4,890,652. However, of these known devices most of them are fairly elaborate and are designed specifically for industrial applications. Moreover, these devices are rigidly attached to another member and none of these references relate to a device which is pivotable, simple in construction and use, inexpensive to manufacture and suitable for home use.

Wherefore it is a primary objective of the invention to provide a lightweight, inexpensive and durable device for assisting a user of the device with transferring a sandwich, or the like, into a flexible container.

Another object of the invention is to provide a device which maintains a flexible container, such as a sandwich bag or the like, in an opened position so that the sandwich or other object supported thereby is readily and easily received by the container.

A still further object of the invention is to provide a device having one end edge which is sufficiently spaced from a surface supporting the device so that the plastic sandwich bag, or the like, can easily be positioned under that raised end edge to facilitate transfer of the sandwich or other object into an opening of the sandwich bag.

Still another objective of the invention is to provide a device which can be easily molded from a durable plastic material that allows the sandwich or other object to be cut into two or more pieces when supported by the device.

The above and other objects of the invention will become apparent to those skilled in the art once the invention is better understood.

SUMMARY OF THE INVENTION

According to the invention, there is provided a device for assisting a user to transfer an object supported by the device into a storage container, said device comprising a substantially flat base member having a pair of opposed side edges with a pair of opposed end edges normal thereto, a side wall, extending substantially perpendicularly from one surface of said base member, along each of said two opposed side edges, and protrusion means projecting substantially normal to a surface opposite said one surface, of said base member, to provide a pivot about which said device can pivot, said pivot being on an axis substantially normal to said side walls, parallel to said opposite surface and being spaced from said opposite surface and from each of said opposed end edges, wherein when said device is a flat support surface with said protrusion means engaging that support surface, said axis lies in the plane of said support surface with only one end edge of said base member able to contact that support surface at any given time thereby to facilitate engagement with a said storage container and transfer of a said object.

According to a second embodiment of the invention, there is provided a method of assisting a user with the transfer of an object supported by a device into a flexible storage container, said method comprising the steps of using a device comprising a substantially flat base member having a pair of opposed side edges with a pair of opposed end edges normal thereto, a sidewall, extending substantially perpendicularly from one surface of said base member, along each of said two opposed side edges, and protrusion means projecting substantially normal to a surface opposite said one surface, of said base member, for providing a pivot about which said device can pivot, said pivot being on an axis substantially normal to said side walls, parallel to said opposite surface and being spaced from said opposite surface and from each of said opposed end edges, placing said device on a flat support surface whereby said protrusion means engages that support surface and only one end edge of said base member contacts that support surface; placing a said object on said one surface; applying a said storage container over the raised end edge of said device; pivoting said device about protrusion means so that the raised end edge of said device contacts that support surface; and transferring a said object from the device into a said storage container.

BRIEF DESCRIPTION OF THE DRAWING

The invention will be described, by way of example, with reference to the accompanying drawings in which:

FIG. 1 is a top plan view showing a diagrammatic representation of the device according to the present invention;

FIG. 2 is a left side diagrammatic elevational view of the device on the direction of arrows 2—2 of FIG. 1;

FIG. 3 is a diagrammatic representation showing use of the device when supported by a surface;

DETAILED DESCRIPTION OF THE PREFERRED EMBODIMENT

Figure 4:
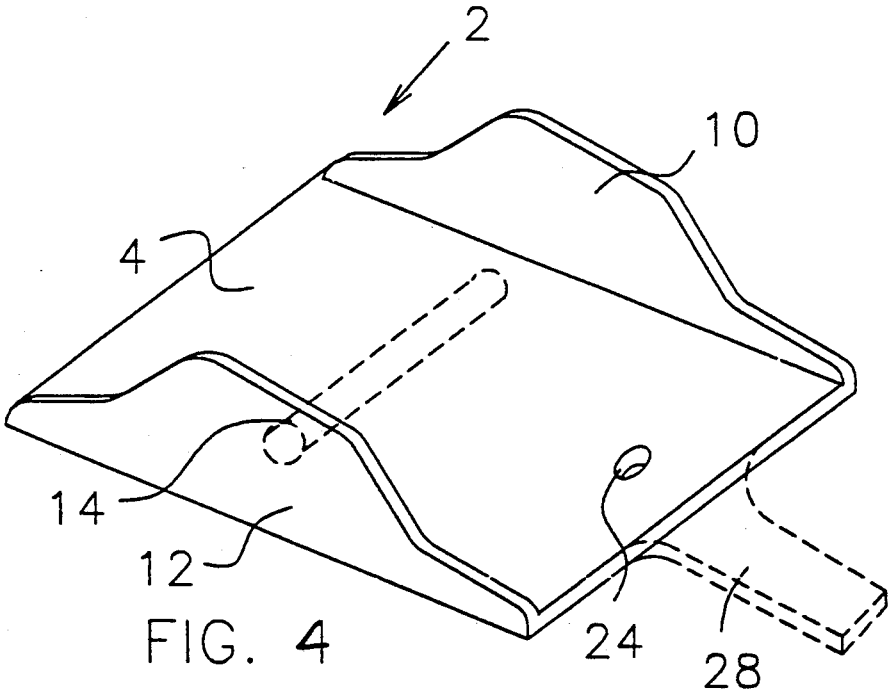
FIG. 4 is a diagrammatic perspective view showing a second embodiment of the device.

Now turning to FIGS. 1, 2 and 4, the device 2 of the present invention is shown and will now be described in detail. The device 2 consists of a substantially flat base member 4 having a rectangular plan configuration. The base member 4 includes a pair of opposed side edges 6, 8 each supporting a side wall 10, 12, respectively, which extends substantially perpendicular from that edge of the base member and a pair of opposed end edges 11, 13. Protrusion means 14 projects substantially normal from the opposite surface of the base member and extend or are located along a transverse axis T of the device remote from both end edges 11, 13. The protrusion means 14 can be an elongate cylindrical member extending along the transverse axis T of the device (shown in ghost in FIG. 4), or two or more identical protrusion members which are spaced apart from one another along the transverse axis T of the device, such as a pair of partial spherical members or the like, and project substantially normal to the bottom surface of the base member. It is anticipated that the partial spherical members will comprise half spheres having a radius of about ⅛" or that the elongate cylindrical member will have a radius of about 1/16". However, it is to be appreciated that other dimensions and/or types of protrusion members are also possible and are considered to be within the spirit and scope of the present invention.

Turning now to FIG. 3, the operation of the device will now be described in detail. The device 2 is placed upon a flat support surface 18 such as a table or counter top so that the protrusion means 14 engages the support surface 18. Once so engaged, the device 2 is able to pivot about the protrusion means 14 so that only one end edge 11 or 13 of the base member 4 is in contact with the support surface 18 at any given time. The purpose of this pivoting action of the device is to raise a portion of the device (end edge 13) to permit a flexible storage container 15, such as a sandwich bag or the like, to engage and substantially encase that raised portion, as can be seen in FIG. 3. As the opening 20 of the storage container 15 is slide over and surrounds the raised portion of the device, the base member 4 and the opposed side walls 10, 12 expand the opening 20 until it is in a fully opened position so that it can readily receive the sandwich or object 22 supported by the device. Thereafter, the device is pivoted about the protrusion means 14 so that the raised portion of the device is lowered and the end edge 13 contacts the support surface 18 to assist with sliding transfer of the sandwich or object 22 into the flexible storage container 15. If desired, the end edge 11 of the device 2 which is not engaged by the container 15 can be raised sufficiently above the support surface 18 so that gravity assists with the sliding transfer of the sandwich or object 22 into the container 15. In FIG. 4, a handle 28 (shown in ghost) assists with raising the end edge 11 of the device 2 which is not engaged by the container 15 sufficiently above the support surface 18 so that gravity assists with the sliding transfer of the sandwich or object 22 into the container 15.

Figure 5:
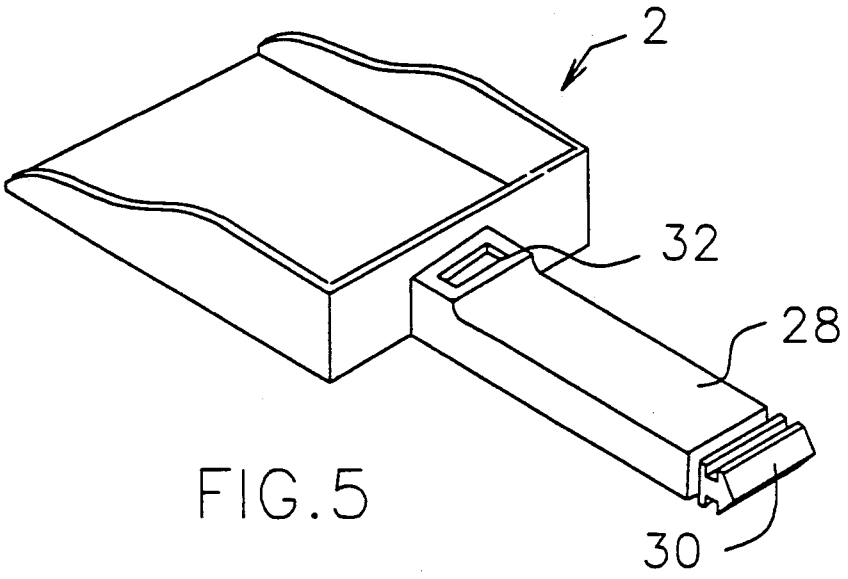
FIG. 5 is a diagrammatic perspective view showing a further embodiment of the handle.
Figure 6:
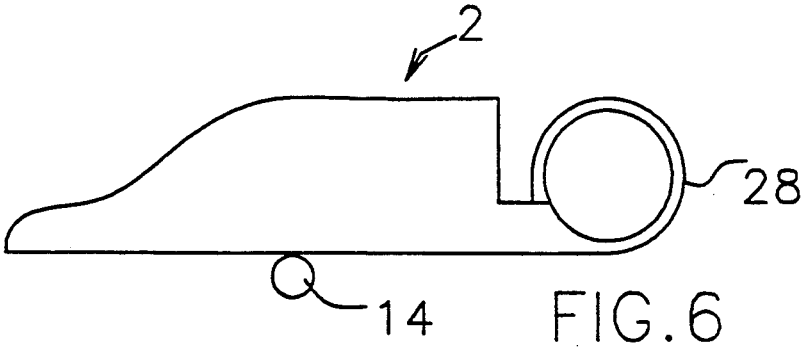
FIG. 6 is a side elevational view of the embodiment of FIG. 5 after the remote end of the handle has been connected.

A further embodiment of the handle 28 can be seen in FIGS. 5 and 6. In this embodiment, the handle 28 comprises a flat, thin rectangular shape member having aperture means 32 at an end thereof adjacent the base member and protrusion or engaging means 30 at the remote end for engaging the aperture means 32. Once the protrusion and aperture means are interconnected, the handle 28 will form a cylindrical handle member which can be readily grasped by the user for assisting with sliding transfer of an object.

The best mode envisioned contemplates a device that can accommodate transfer of an ordinary sandwich whose dimensions are approximately 4.3"×4.3"1.0". Therefore, to accommodate such an object, the base member should preferably measure about 4.5" by 6.0" with side walls having a height of about 1⅜" and a thickness of ⅛". Additionally, the side walls of the device preferably taper toward the end edges to facilitate the application of the container around the device. The taper begins near the center of the device, where an edge of the side wall is parallel with the base member, and feathers toward the opposed end edges. It is to be noted that the pivoting action is the important feature of this device in that it allows a storage container to be easily applied thereto and also assists with free transfer of an object into the storage container.

The device is envisioned to be a unitary structure molded from plastic or other similar materials, such as polypropylene, or manufactured from a metal such as stainless steel. The chosen material, however, must be hard and durable enough to withstand the cutting of a sandwich 26 on the base member with a knife or other sharp instrument into two or more pieces while still being safe for cleaning in a dishwasher.

It is preferred that all of the exposed edges and transitions of the device will be curved and smooth so as to avoid any sharp surfaces or edges which may rip or tear the flexible storage container.

Since certain changes may be made in the above described dispensing device without departing from the spirit and scope of the invention herein involved, it is intended that all of the subject matter contained in the above description and shown in the accompanying drawings shall not be construed as limiting the invention, but shall be interpreted as being illustrative of the inventive concept herein involved.

Wherefore I claim:

1. A device for assisting a user with transfer of an object supported by the device into a storage container, said device comprising a substantially flat base member having a pair of opposed side edges with a pair of opposed end edges normal thereto, a side wall extending substantially perpendicularly from one surface of said base member along each of said two opposed side edges, and protrusion means projecting substantially normal to a surface opposite said one surface of said base member to provide a pivot about which said device is freely pivotable when said protrusion means engages a support surface, said pivot being aligned on an axis substantially normal to said side walls, parallel to and spaced from said opposite surface and spaced from each of said opposed end edges, wherein when said device is resting on a flat support surface with at least said protrusion means engaging that support surface, said axis lies in the plane of said support surface with only one end edge of said base member being able to contact that support surface at any given time, said device being freely pivotable about the pivot of the protrusion means so that either end edge of said device can be pivoted into contact with the support surface thereby to facilitate engagement with a said storage container with a raised end edge of said device, and said device is freely liftable from the support surface, without being disconnecting therefrom, to assist with transfer of a said object.

2. A device as claimed in claim 1, wherein said side walls taper toward at least one end edge of the device to facilitate engagement with a said storage container.

3. A device as claimed in claim 1, wherein said protrusion means is an elongate cylindrical member having a radius of between an 1/16" and ⅛".

4. A device as claimed in claim 1, wherein said protrusion means comprises at least two separate spaced apart members.

5. A device as claimed in claim 4, wherein each said spaced apart separate member is partially spherical having a radius of about ⅛".

6. A device as claimed in claim 1, wherein said side walls are parallel to and spaced apart from one another by a distance of about 4.5", and said side walls having a height of about 1⅜".

7. A device as claimed in claim 1, wherein the device has smooth edges and surfaces to minimize the possibility of said flexible storage container being ripped or torn when engaging the device.

8. A device as claimed in claim 1, wherein said device is made of a durable plastic material.

9. A device as claimed in claim 8, wherein said plastic material is polypropylene.

10. A device as claimed in claim 1, wherein said base member is approximately $4\frac{3}{4}''$ wide and 6" long.

11. A device as claimed in claim 1, wherein a handle is attached, to an end edge of the device which is not intended to be engaged by a said storage container, to assist with raising that end edge sufficiently above a said support surface so that gravity assists with sliding transfer of a said object into a said storage container.

12. A device as claimed in claim 1, wherein said handle means is a cylindrical member.

13. A device as claimed in claim 1, wherein said device is made of metal.

14. A device as claimed in claim 1, wherein the axis defined by the protrusion means is substantially centered between the two end edges of said device.

15. A method of assisting a user with the transfer of an object supported by a device into a flexible storage container, said method comprising the steps of:

using a device comprising a substantially flat base member having a pair of opposed side edges with a pair of opposed end edges normal thereto, a sidewall, extending substantially perpendicularly from one surface of said base member, along each of said two opposed side edges, and protrusion means projecting substantially normal to a surface opposite said one surface, of said base member, for providing a pivot about which said device can pivot, said pivot being on an axis substantially normal to said side walls, parallel to said opposite surface and being spaced from said opposite surface and from each of said opposed end edges, placing said device on a flat support surface whereby said protrusion means engages that support surface and only one end edge of said base member contacts that support surface;

placing a said object on said one surface;

applying a said storage container over the raised end edge of said device;

pivoting said device about protrusion means so that the raised end edge of said device contacts that support surface; and transferring a said object from the device into a said storage container.

16. A device for assisting a user with transfer of an object supported by the device into a storage container, said device consisting of a substantially flat base member having a pair of opposed side edges with a pair of opposed end edges normal thereto, a side wall extending substantially perpendicularly from one surface of said base member along each of said two opposed side edges, and protrusion means projecting substantially normal to a surface opposite said one surface of said base member to provide a pivot about which said device is freely pivotable, said pivot defining an axis extending substantially normal to said side walls, parallel to but spaced from said opposite surface and located substantially at a center area of the base member between each of said opposed end edges, wherein when said device is resting on a flat support surface with said protrusion means abutting that support surface, said axis lies in the plane defined by said support surface with only one end edge of said base member being able to contact that support surface at any given time, said device being freely pivotable about the pivot of the protrusion means so that either end edge of the device can be pivoted into contact the support surface thereby to facilitate engagement with a said storage container with a raised end edge of said device, and said device is freely liftable from the support surface, without being disconnecting therefrom, to assist with transfer of a said object from said device into said storage container.

17. A device as claimed in claim 16, wherein a handle is attached to an end edge of the device remote from the end edge to be engaged by a said storage container, said handle facilitating lifting of said device from said support surface to assist with transfer of a said object.

* * * * *